US006754924B1

(12) United States Patent
Brady et al.

(10) Patent No.: US 6,754,924 B1
(45) Date of Patent: Jun. 29, 2004

(54) MATERNITY SUPPORT SYSTEM

(76) Inventors: Judy A. Brady, 6161 Mississippi La., New Market, MD (US) 21774; Edie C. Armstrong, 10319 Cleveland St., Fairfax, VA (US) 22030

( * ) Notice: Subject to any disclaimer, the term of this patent is extended or adjusted under 35 U.S.C. 154(b) by 303 days.

(21) Appl. No.: 09/591,249

(22) Filed: Jun. 9, 2000

Related U.S. Application Data

(60) Provisional application No. 60/139,060, filed on Jun. 11, 1999.

(51) Int. Cl.[7] ..... A47G 9/00

(52) U.S. Cl. ..... 5/655; 5/640; 5/657; 5/922; 5/631

(58) Field of Search ..... 5/640, 631, 655, 5/630, 657, 655.9, 930, 922, 490, 491; 128/845, 846, 890

(56) References Cited

U.S. PATENT DOCUMENTS

| | | | | | |
|---|---|---|---|---|---|
| 2,689,845 | A | * | 9/1954 | Melrose | 564/1.5 |
| 4,506,396 | A | * | 3/1985 | Ritchie et al. | 5/431 |
| 4,924,543 | A | * | 5/1990 | Hoss et al. | 5/421 |
| 4,959,880 | A | * | 10/1990 | Tesch | 5/490 |
| 5,193,238 | A | * | 3/1993 | Clute | 5/655 |
| 5,689,845 | A | * | 11/1997 | Sobieralski | 5/654 |
| 6,141,805 | A | * | 11/2000 | Fisher-Cohen et al. | 5/420 |
| 6,151,733 | A | * | 11/2000 | Takashima | 5/636 |
| 6,189,169 | B1 | * | 2/2001 | Marcotte | 5/655 |

OTHER PUBLICATIONS

The Anna Pillow web page, Aug. 24, 2000, 2 pages.
Bareware web page, Aug. 24, 2000, 4 pages.
BabyCenter web page, Aug. 24, 2000, 5 pages.
Transitions, Inc. web page, Aug. 24, 2000, 1 page.
Bosom Buddies, Inc. web page, Aug. 24, 2000, 1 page.
Medela, Inc. web page, Aug. 24, 2000, 1 page.
MEDELA, Inc., The Nursing Pillow, brochure, 1994, 1 page.
ZENOFF Products, Inc., My Brest Friend brochure, 2 pages.
Nurse Mate brochure, 2 pages.
The Family Care Company, The Nifty Nurser brochure, 2 pages.

* cited by examiner

*Primary Examiner*—Teri Pham Luu
*Assistant Examiner*—Fredrick Conley
(74) *Attorney, Agent, or Firm*—Skinner and Associates

(57) ABSTRACT

A maternity support system, comprising a first element and a second element connected to the first element. The first element and the second element are positioned and arranged with respect to each other for a maternity support use, such as supporting an expectant mother's body during pregnancy, supporting a caregiver feeding an infant, supporting an infant during feeding, and supporting an infant learning to sit. The elements may either be integrally formed as a unitary pad, or may be removably attached to each other using a connector, such as VELCRO hook and loop fasteners, for example. In a preferred embodiment, the elements comprise pillow covers adapted for receiving a conventional bed pillow. The invention is further directed toward: a maternity support set comprising at least two flexible bodies each adapted for receiving a pad, and at least one connector adapted for removably attaching the at least two flexible bodies together to form a maternity support system; a pattern for making a pillow cover set; a method of making a maternity support system for use with at least two conventional bed pillows; and a method of providing maternity support to a caregiver feeding an infant.

3 Claims, 22 Drawing Sheets

MATERNITY SUPPORT SYSTEM

CROSS-REFERENCE TO RELATED APPLICATIONS, IF ANY

This application claims the benefit under 35 U.S.C. §119 (e) of U.S. provisional application Serial No. 60/139,060, filed Jun. 11, 1999.

37 C.F.R. §1.71(e) AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to comfort and support articles, and to covers for such articles. More particularly, the invention relates to a maternity support system used to support an expectant mother's body during pregnancy, to support the caregiver and/or the infant during the feeding of the infant, and to support an infant learning to sit.

2. Background Information

The state of the art in general includes various maternity-related comfort and support articles. The state of the art in general includes a variety of breastfeeding support articles such as pillows, pads or cushions. These devices are arranged by the caregiver to support the infant or a portion of the infant, the caregiver or a portion of the caregiver's body, and/or the bottle, container or breast during a feeding process.

These devices and methods are believed to have significant limitations and shortcomings. The caregiver's own personal conventional bed pillows often are used because of their familiar feel and smell. However, bed pillows tend to move, shift or slide out of position, and thereby lose their effectiveness for support and comfort. Other specialty breastfeeding support articles are provided in limited sizes and shapes, and therefore may be difficult to fit or use in the desired positions and locations. These difficulties become evident when the support articles are used by different-sized caregivers, and when the caregiver is using some types of furniture. For example, the known foam support articles can be difficult and uncomfortable to use in a chair with arms, such as a rocking chair. Furthermore, many of the known devices are difficult to clean as they are not readily laundered. Either they are simply wiped off or they require a separate, relatively expensive cover that can be laundered.

This invention provides a maternity support system that is economical, easy-to-arrange, easy-to-clean, adjustable, reliable, comfortable and stable. The present invention provides maternity support, defined herein to include support for an expectant mother's body during pregnancy, support for a caregiver feeding an infant, support for an infant being fed, and support for an infant learning to sit. As such, the present invention is believed to constitute an improvement over existing technology.

BRIEF SUMMARY OF THE INVENTION

The present invention provides a maternity support system, a maternity support set, a pattern for making a pillow cover set, a method of making a maternity support system for use with at least two conventional bed pillows, and a method of providing maternity support to a caregiver feeding an infant.

The maternity support system generally comprises a first element and a second element connected to the first element. The first element and the second element are positioned and arranged with respect to each other for a maternity support use, i.e. to support an expectant mother's body during pregnancy, to support a caregiver feeding an infant, to support an infant during feeding, and/or to support an infant learning to sit. As used herein, the term "caregiver" includes mothers, fathers and other persons that provide care to an infant, and the term "feeding" includes but is not limited to breast feeding and bottle feeding. The elements may either be integrally formed as a unitary support article, or may be removably attached to each other using a connector. In a preferred embodiment, the elements comprise pillow covers adapted for receiving a conventional bed pillow, which are removably attached to each other using VELCRO hook and loop fasteners as the connector. Pillow covers, as defined herein, include pillow cases that have open ends and pillow shams that have open backs.

The maternity support set is a set of items that are used to form a maternity support system that is adapted for a maternity support use, and generally comprises at least two flexible bodies and at least one connector adapted for removably attaching the flexible bodies together. Each flexible body is adapted for receiving a pad, and preferably is a pillow cover, such a pillow sham, adapted for receiving a conventional bed pillow. The connector preferably is VELCRO hook and loop fasteners sewn onto the pillow covers. The support set may further include a bag adapted for packaging, storing, and laundering the flexible bodies. The bag includes a mesh bottom and mesh sides that define a soft-sided, cylindrically-shaped device with an opening. The bag includes a draw string adapted for closing the opening.

The pattern for making a pillow cover set adapted for providing maternity support generally comprises at least one connection pattern piece adapted for instructing a person to attach connectors to at least two pillow covers. The connection pattern piece is preferably a hook and loop fastener pattern piece adapted for instructing the person to attach hook and loop fasteners to the pillow covers. The pattern may further comprise at least one pillow cover pattern piece adapted for instructing the person to make the pillow covers. The pillow cover pattern piece preferably is a pillow sham pattern piece adapted for instructing the person to make pillow shams.

The method of making a maternity support system for use with at least two conventional bed pillows generally comprises the steps of selecting a set of at least two pillow covers and attaching a connective device to said at least two pillow covers. Each of the pillow covers is adapted for receiving a conventional bed pillow. Each pillow cover is removably attached to another pillow cover in the set. In a preferred embodiment the pillow covers are pillow shams, and the connective device is a VELCRO hook and loop fastener sewn on or otherwise attached to the pillow shams. The step of selecting a set of at least two pillow covers may further include the step of making the pillow covers. The method of making a maternity support system for use with at least two conventional bed pillows may further include the step of inserting a conventional bed pillow in each pillow cover.

The method of providing maternity support to a caregiver feeding an infant generally comprises the step of orientating a predetermined shape of both a first element and a second element in a maternity support system about a caregiver. An orientated predetermined shape provides maternity support for a desired feeding position. These feeding positions include but are not limited to a cradle hold position, a cross-cradle hold position, a football hold position, and a lying down position. The method of providing maternity support to a caregiver feeding an infant may further comprise the steps of attaching the first element to the second element to form the predetermined shape, and forming the first and second elements by inserting a standard bed pillow into a first and second pillow cover.

The features, benefits and objects of this invention will become clear to those skilled in the art by reference to the following description, claims and drawings.

FIGS. 9*a* through 11*b* illustrate fabric patterns used in the manufacture of a first sham in a pillow sham set.

FIGS. 12*a* through 14 illustrate fabric patterns used in the manufacture of a second sham in a pillow sham set.

Figure 15:
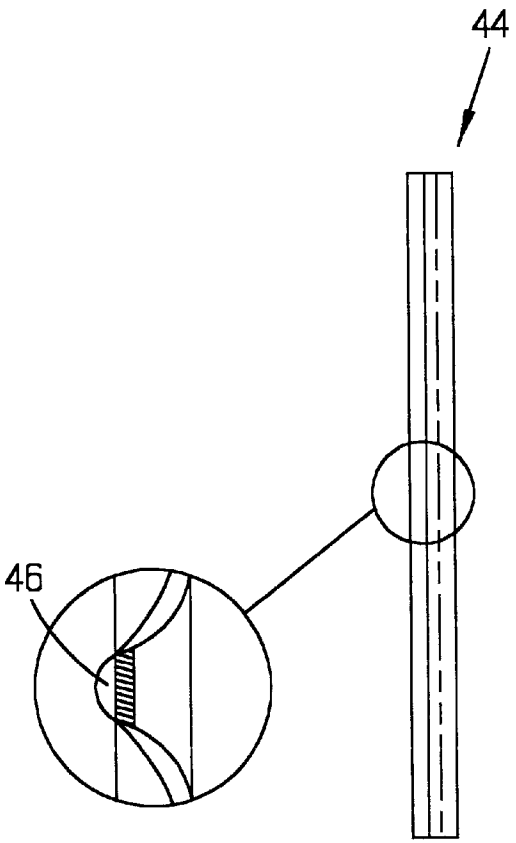
Figure 14:
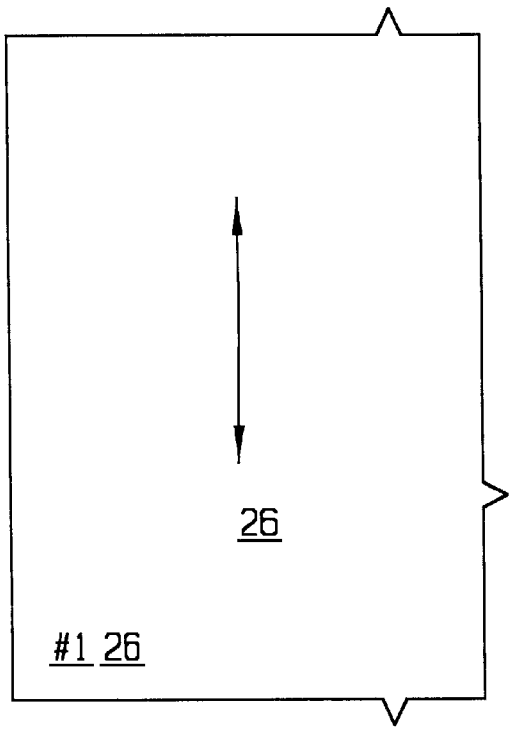
Figure 13:
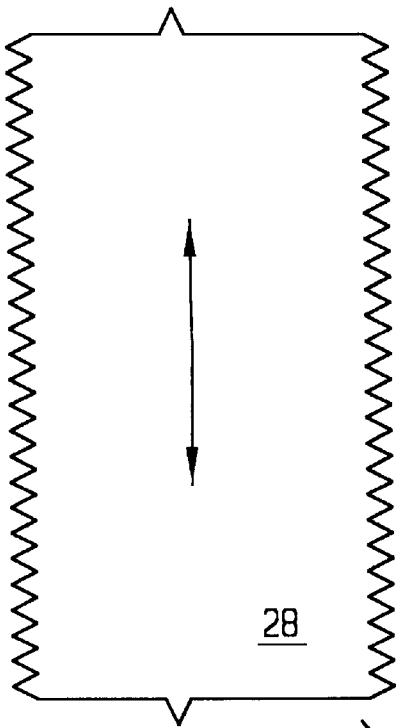
Figure 17:
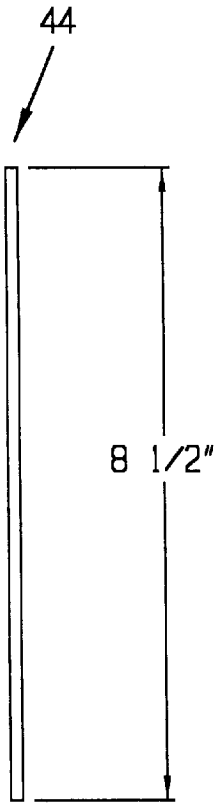
Figure 16:
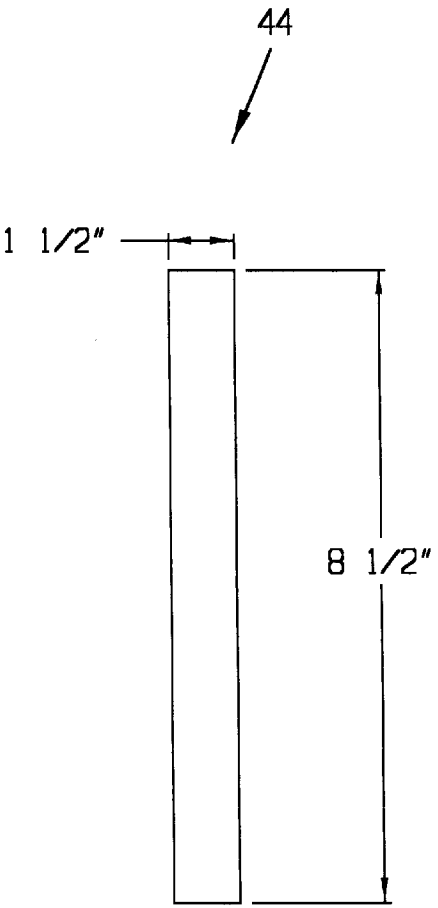

FIGS. 15 through 17 illustrate fabric patterns for the pillow sham edging used for each sham in a pillow sham set.

Figure 8:
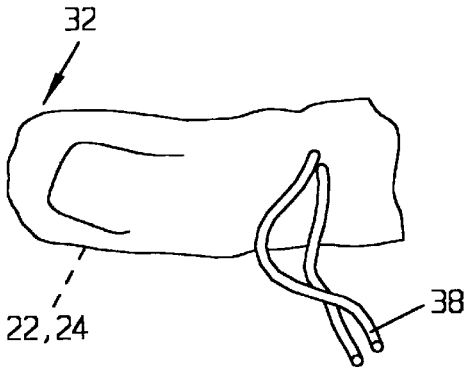
FIG. 8 is an illustration of a maternity support set, wherein a set of pillow shams are placed in a mesh bag.
Figure 10:
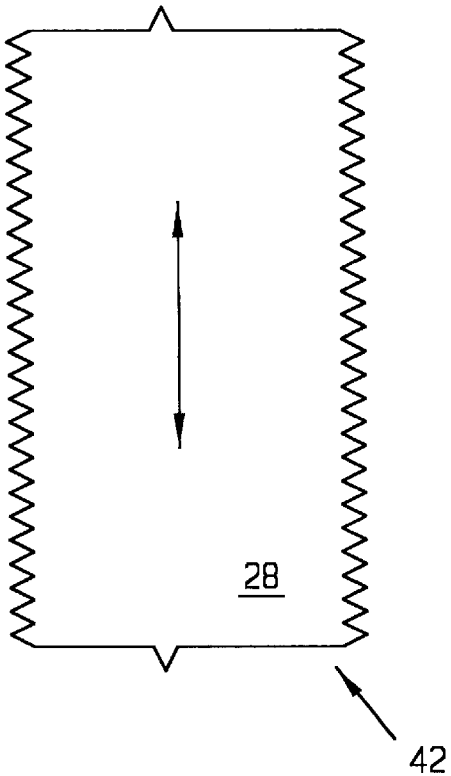
Figure 9B:
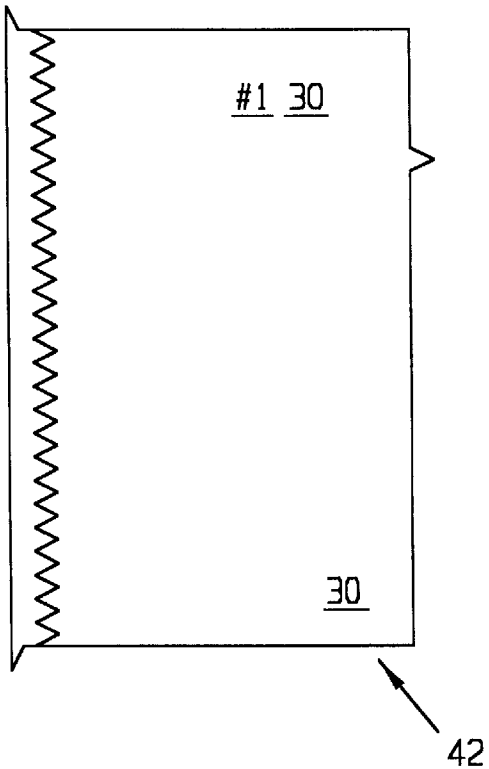
Figure 9A:
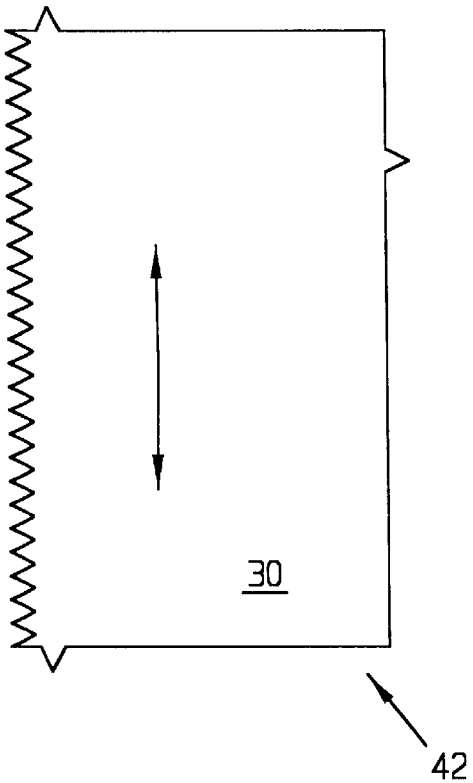
Figure 11A:
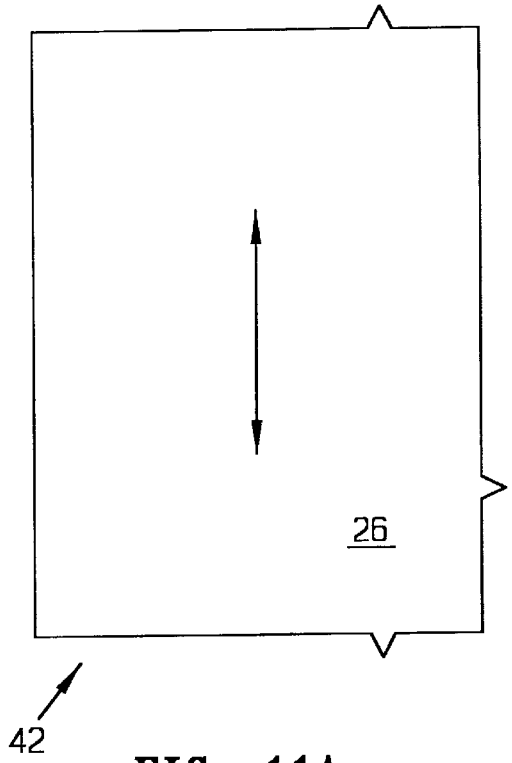
Figure 11B:
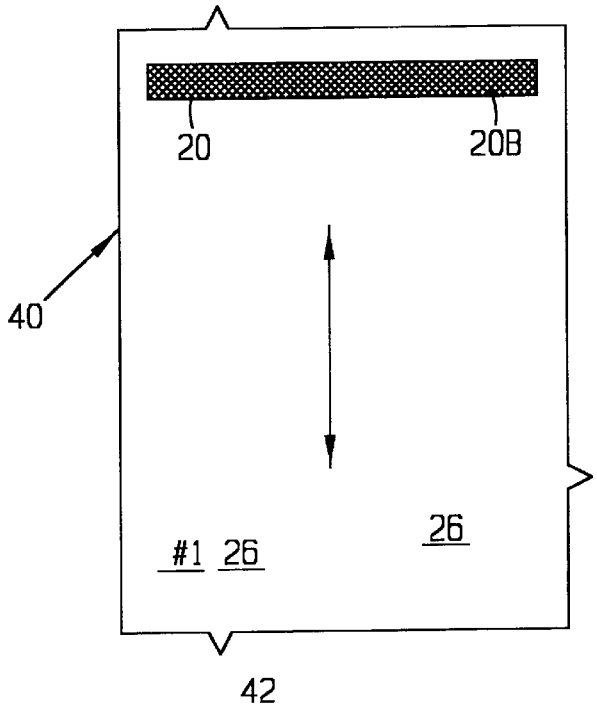
Figures 12A, 12B, 12C:
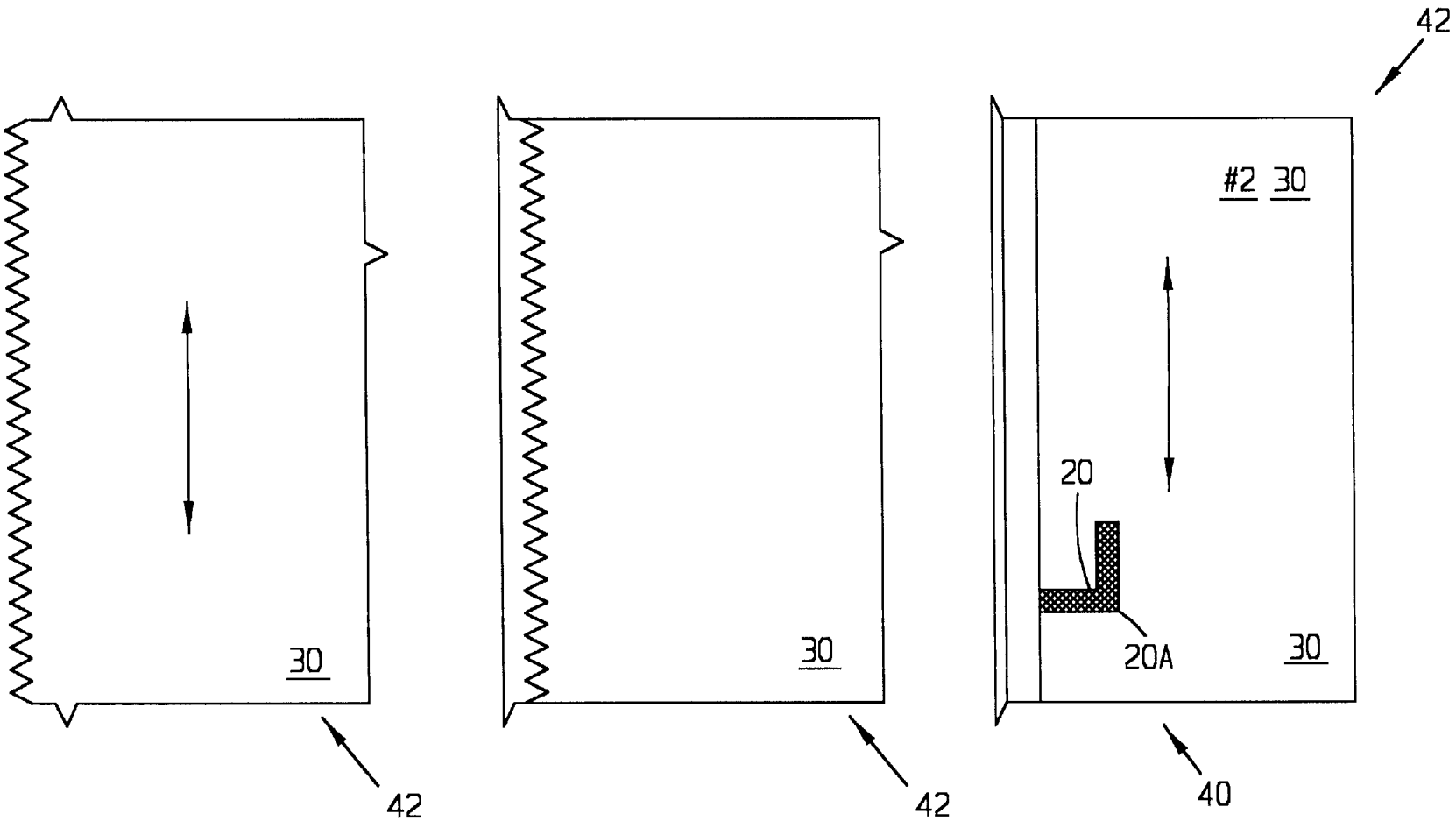
Figure 18:
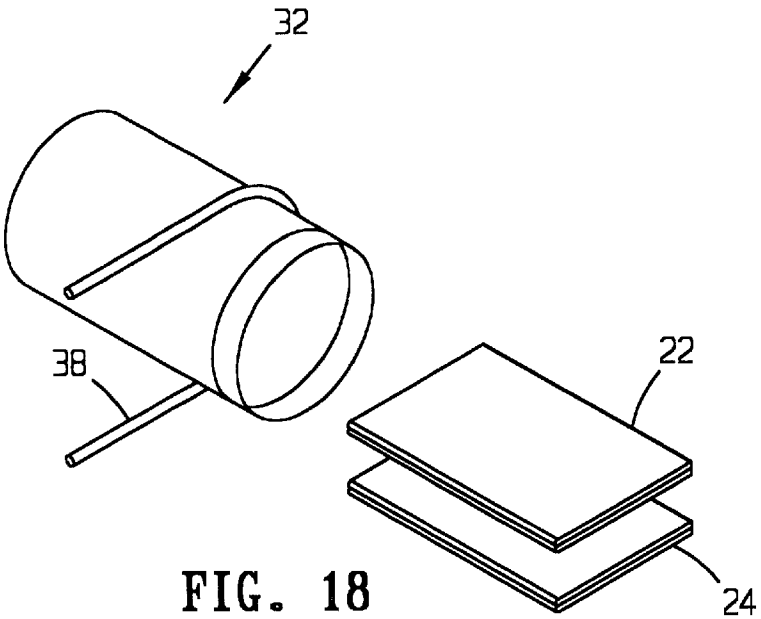

FIG. 18 is an illustration of the maternity support set of FIG. 8.

Figure 19C:
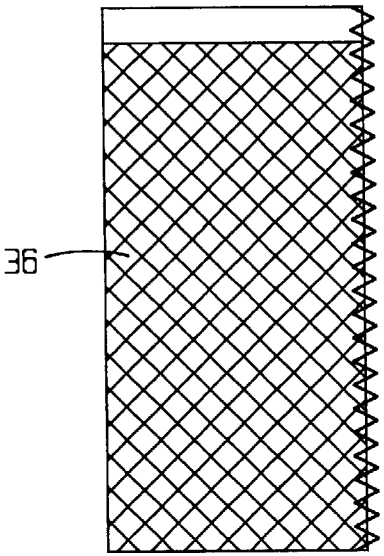
Figure 19B:
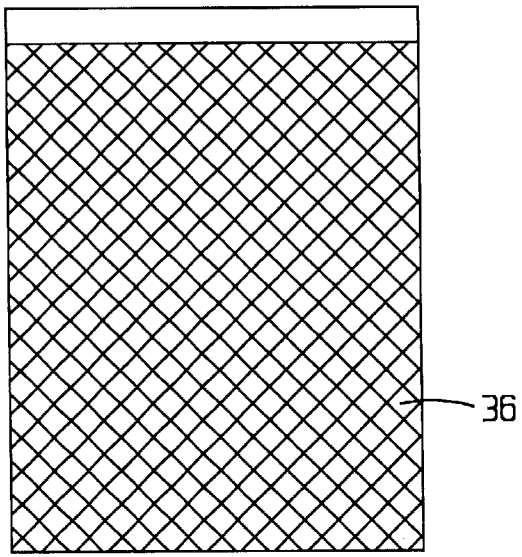
Figure 19A:
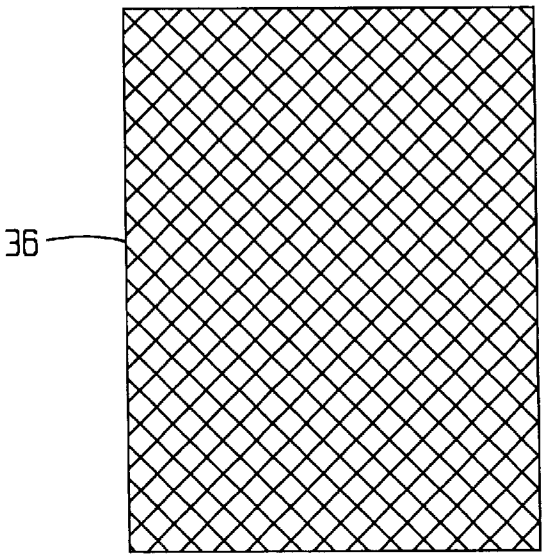
Figure 20:
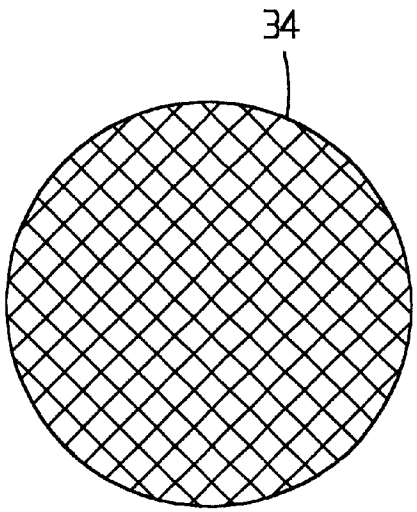
Figure 19D:
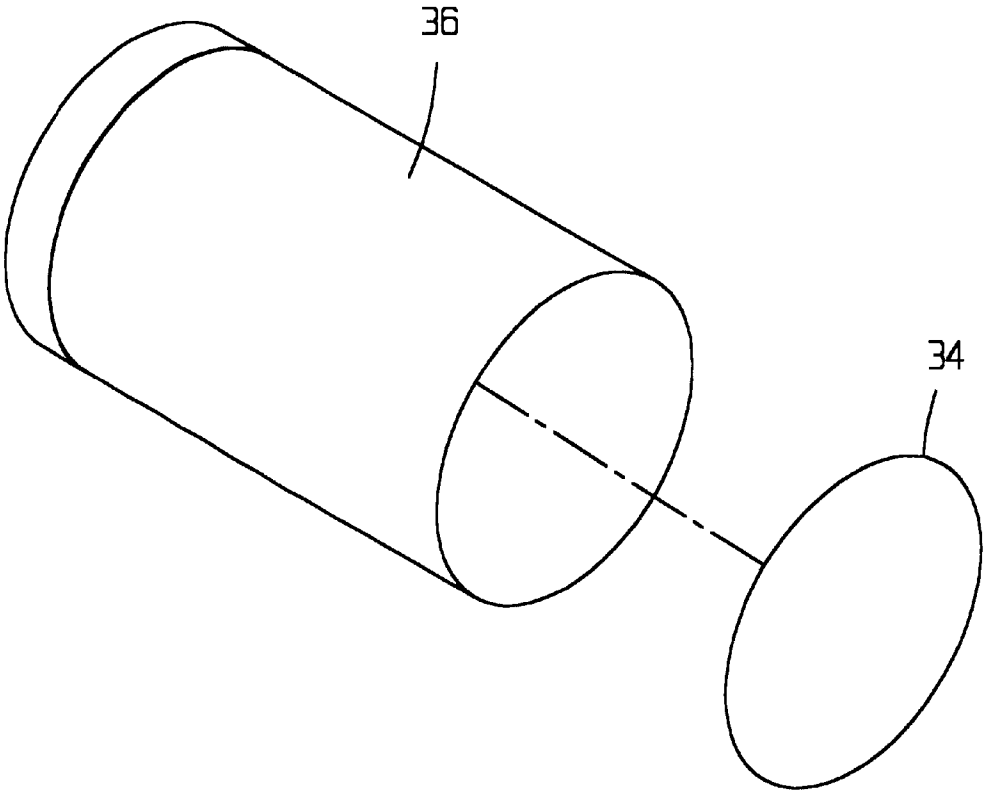

FIGS. 19*a* through 20 illustrate the fabric patterns and the assembly steps for the mesh bag of FIG. 18.

Figure 21A:
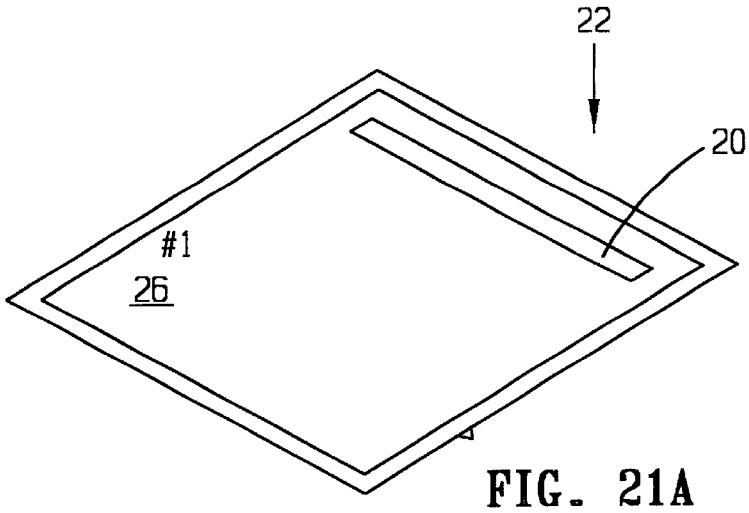
Figure 21B:
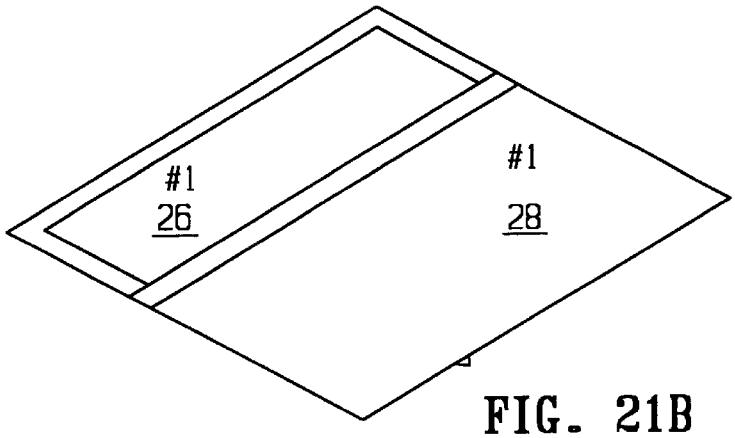
Figure 21C:
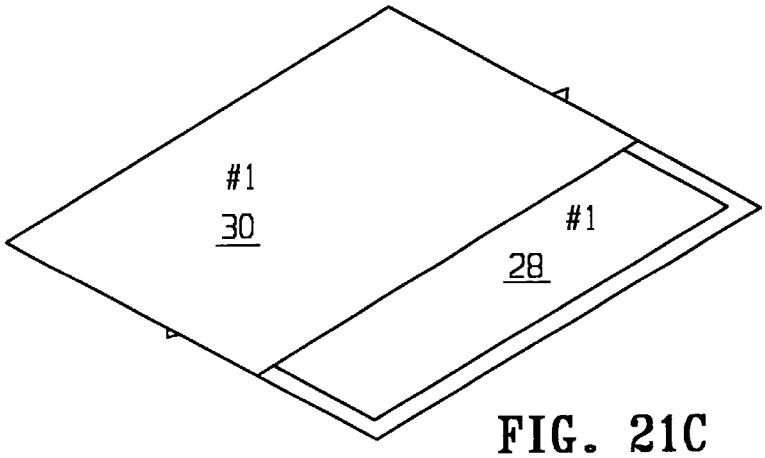

FIGS. 21*a* through 21*c* illustrate the assembly steps for the first sham.

Figure 22A:
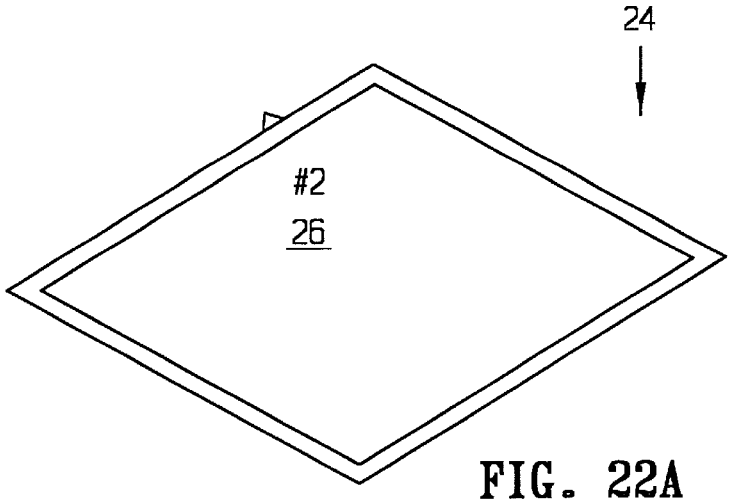
Figure 22B:
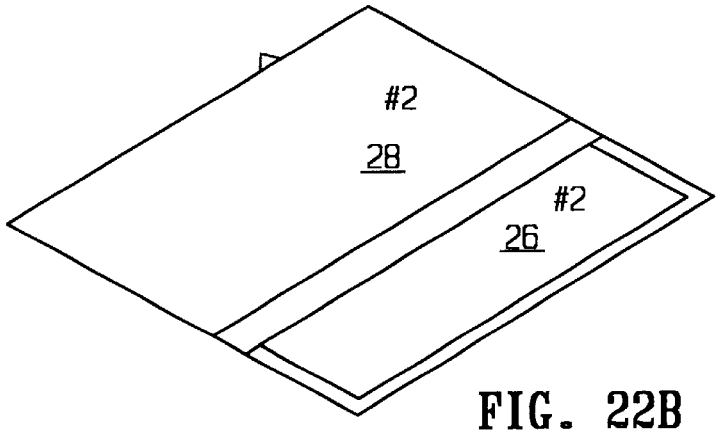
Figure 22C:
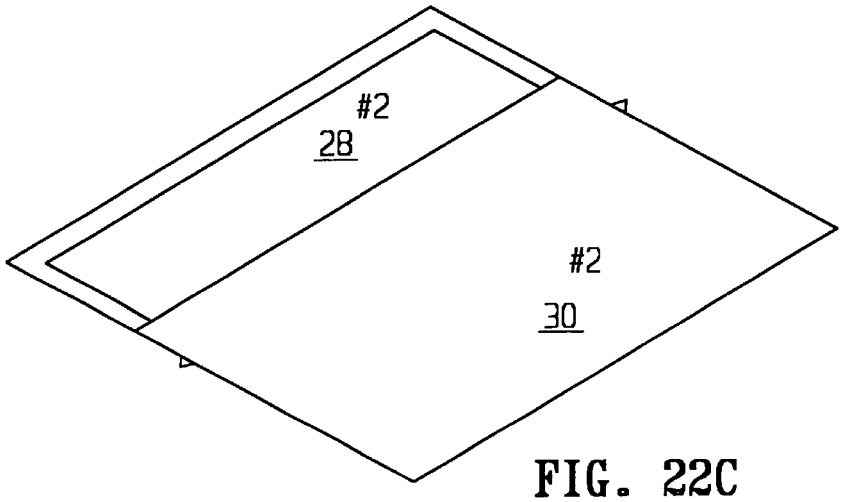
Figure 23A:
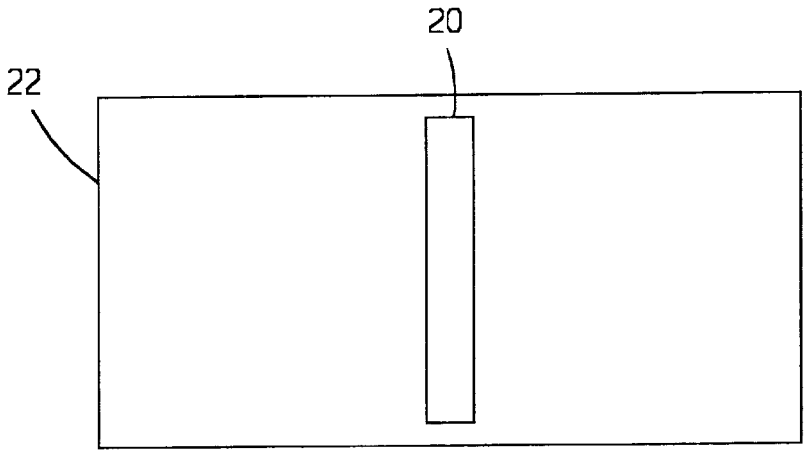
Figure 23B:
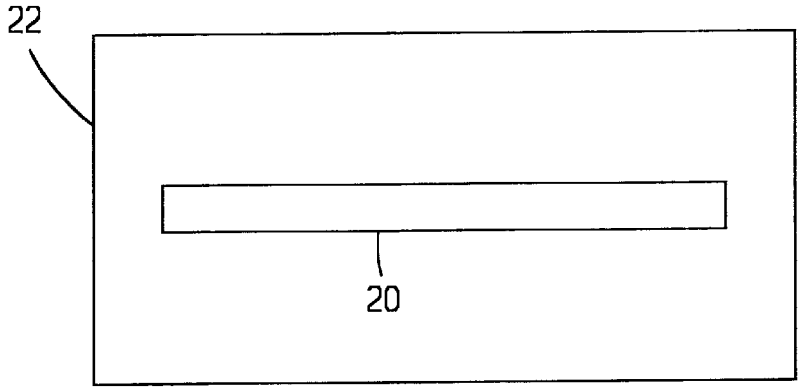
Figure 23C:
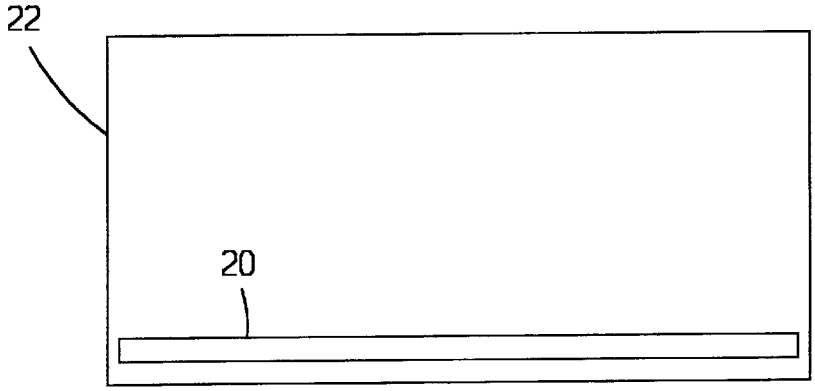
Figure 23D:
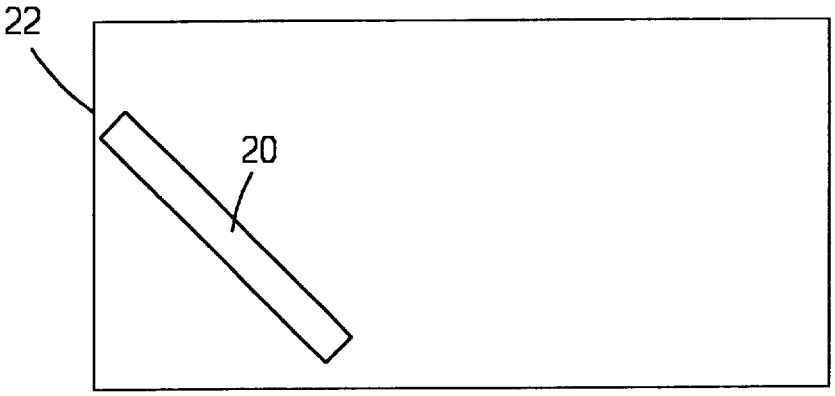
Figure 23E:
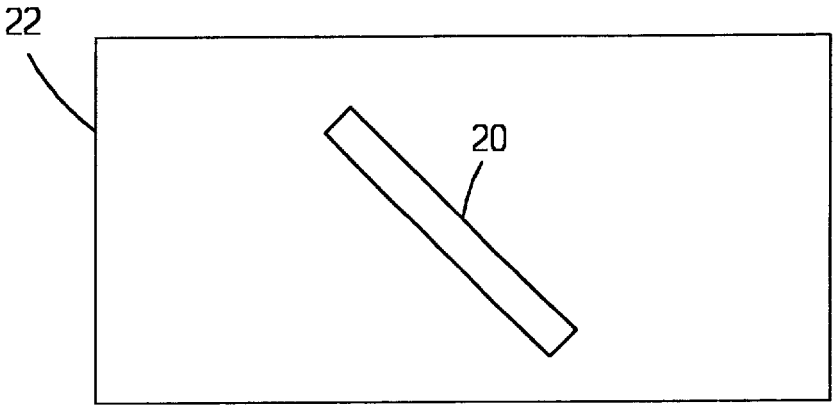
Figure 24A:
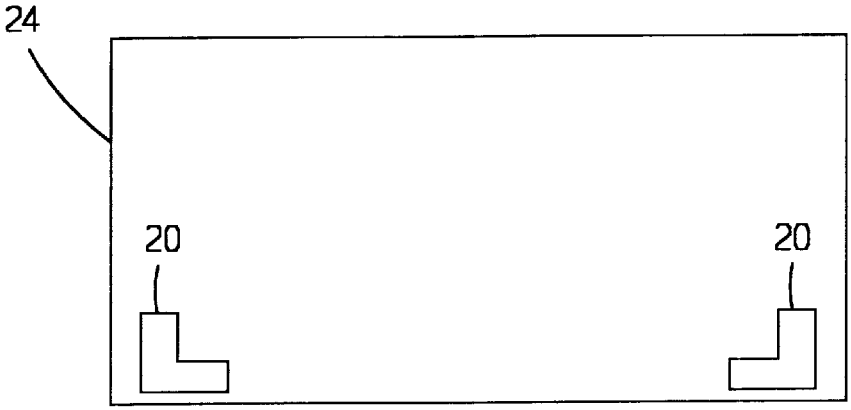
Figure 24B:
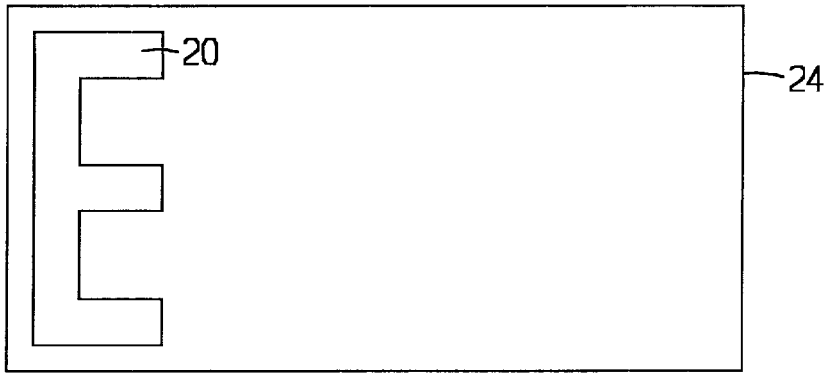
Figure 24C:
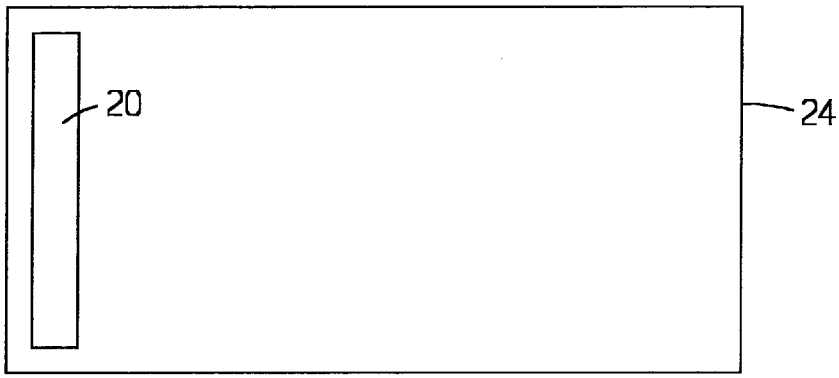
Figure 24D:
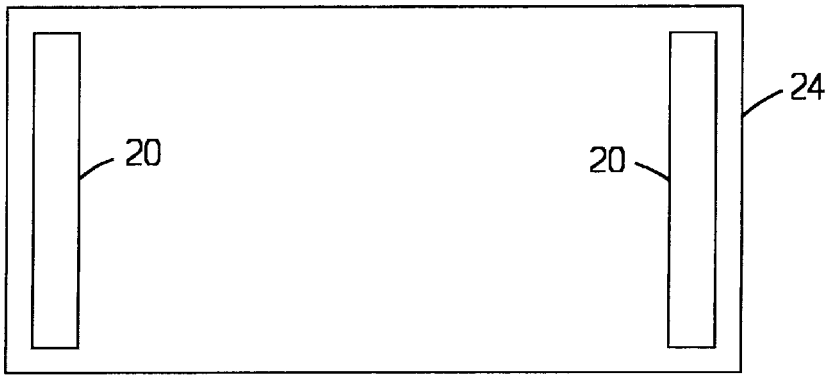
Figure 24E:
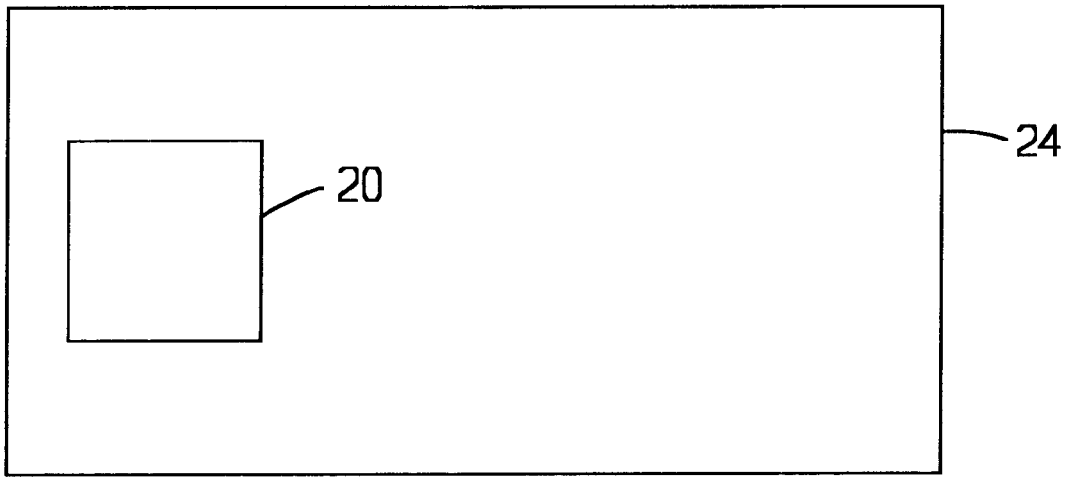

FIGS. 22*a* through 22*c* illustrate the assembly steps for the second sham.

FIGS. 23*a* through 23*e* illustrate a few of many alternative fastener placements for the first sham, and FIGS. 24*a* through 24*e* illustrate the corresponding fastener placements for the second sham.

Figure 25A:
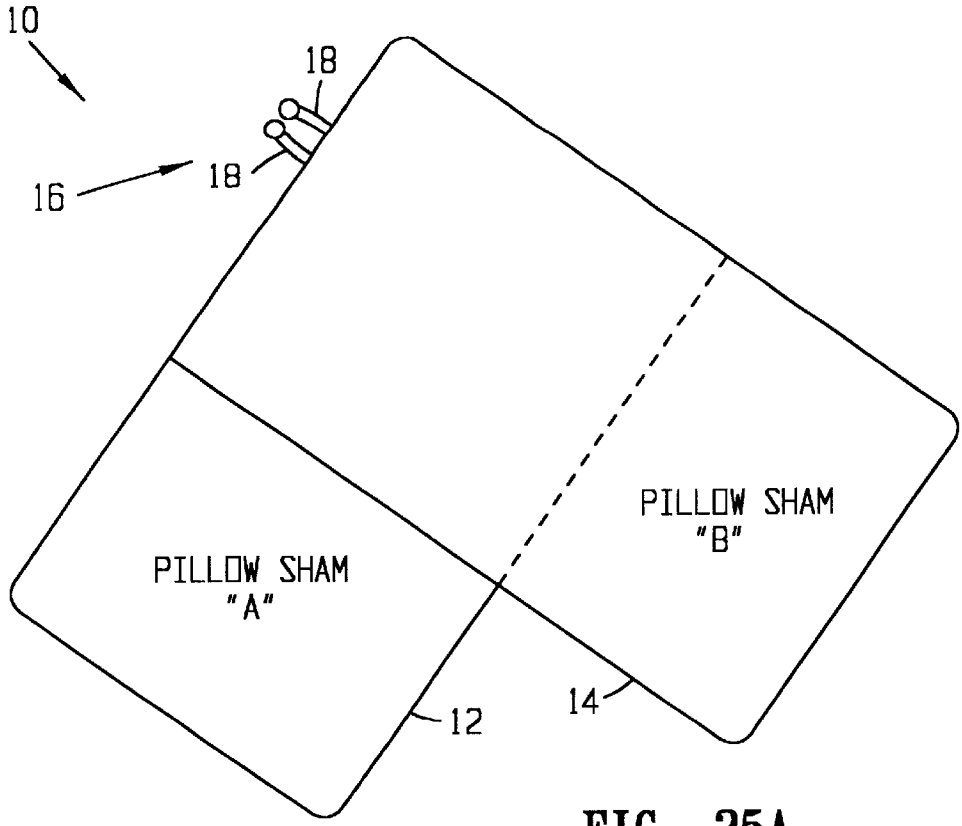
Figure 25B:
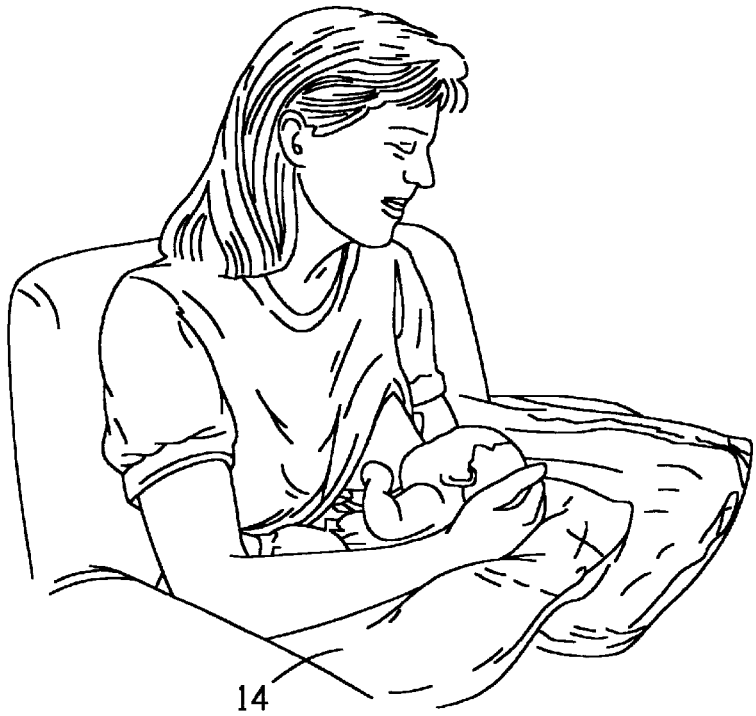

FIGS. 25*a* and 25*b* illustrate an alternative maternity support system design positioned and arranged for nursing an infant in a "cross-cradle hold."

Figure 26A:
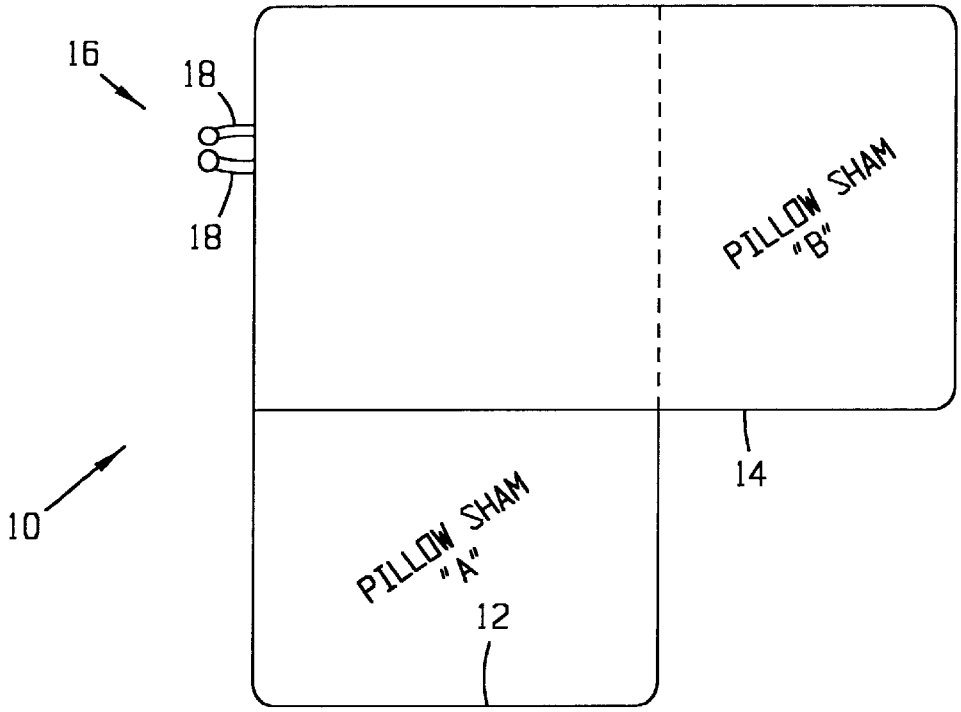
Figure 26B:
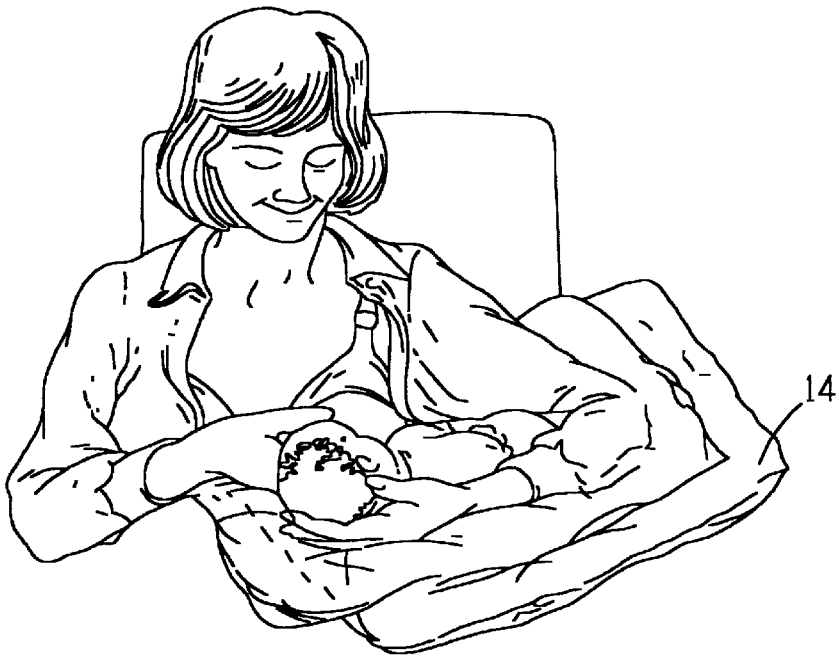

FIGS. 26*a* and 26*b* illustrate an alternative maternity support system design positioned and arranged for nursing an infant in a "football hold."

Figure 27A:
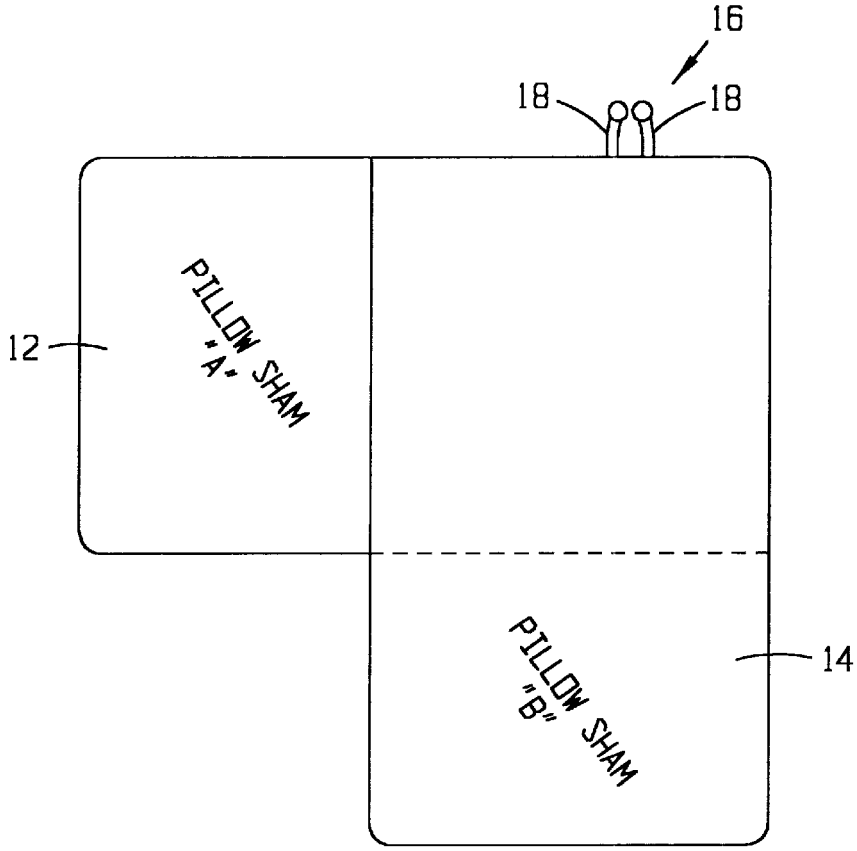
Figure 27B:
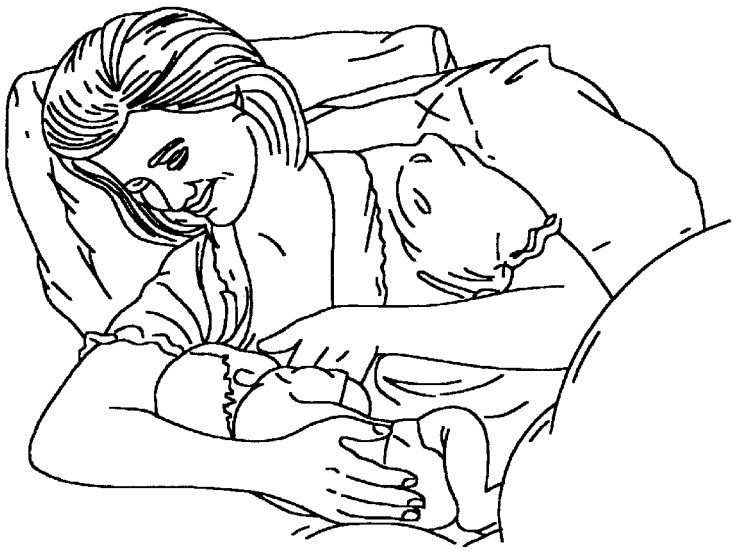

FIGS. 27*a* and 27*b* illustrate an alternative maternity support system design positioned and arranged for supporting a mother who is lying down to nurse an infant.

Figure 28:
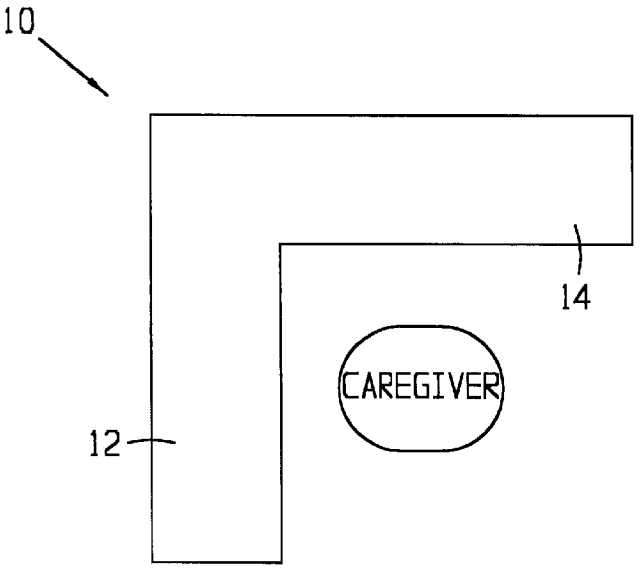

FIG. 28 is a top plan view of an alternative maternity support system design comprising a unitary piece of foam formed in an "L" shape in a first position about a caregiver.

Figure 29:
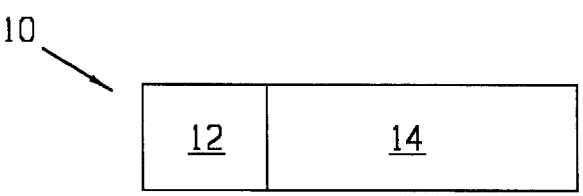

FIG. 29 is a side view of the maternity support system of FIG. 28.

Figure 30:
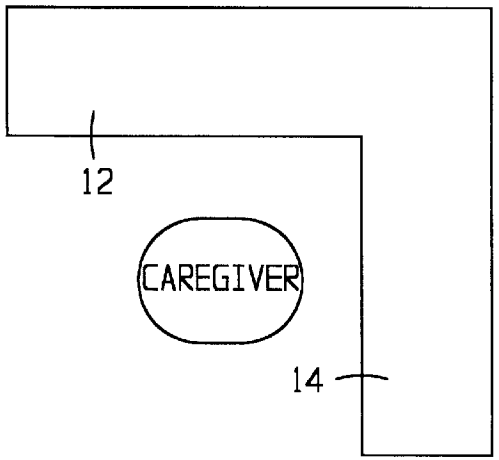

FIG. 30 is a top plan view of the maternity support system of claim 28 in a second position about a caregiver.

Figure 31:
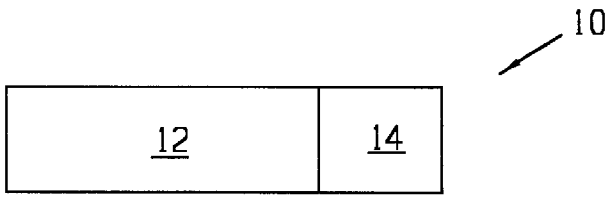

FIG. 31 is a side view of the maternity support system of FIG. 30.

Figure 32:
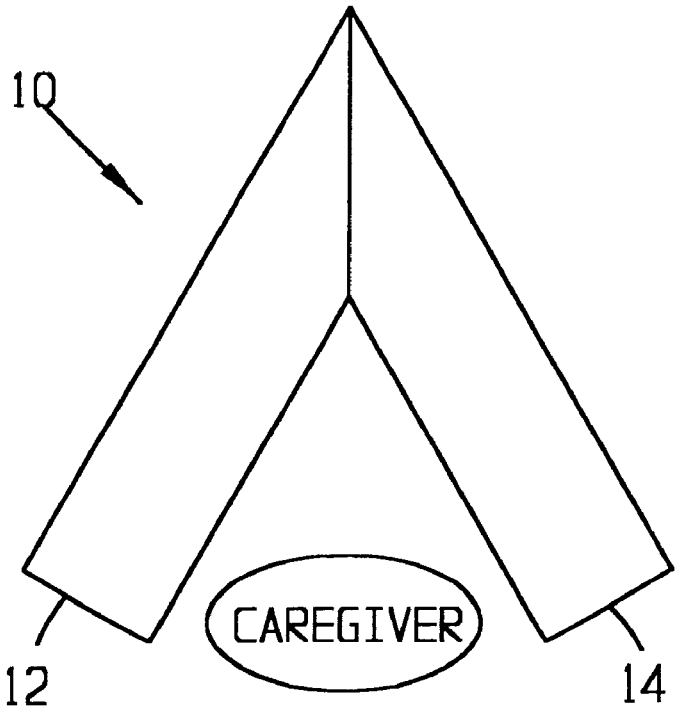

FIG. 32 is an alternative maternity support system comprising a unitary piece of foam formed in an "inverted V" shape in a position about a caregiver.

Figure 33:
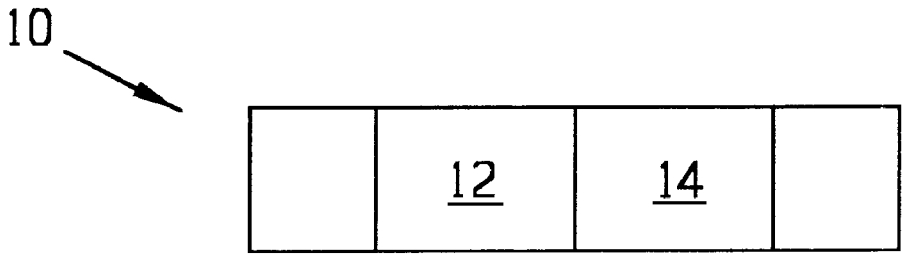

FIG. 33 is a side view of the maternity support system of FIG. 32.

DETAILED DESCRIPTION

Referring to FIGS. 1–33, examples of the preferred embodiment of the present invention are illustrated. The present invention provides a maternity support system, a maternity support set, a pattern for making a pillow cover set, a method of making a maternity support system for use with at least two conventional bed pillows, and a method of providing maternity support to a caregiver feeding an infant.

1. Maternity Support System.

It is desirable to (1) support an expectant mother's body during pregnancy, (2) support a caregiver feeding an infant, (3) support an infant during feeding, and (4) support an infant learning to sit. The first and second support uses focus on the comfort and health of the mother or caregiver, and the third and fourth support uses focus on the comfort and health of the infant.

Figure 2:
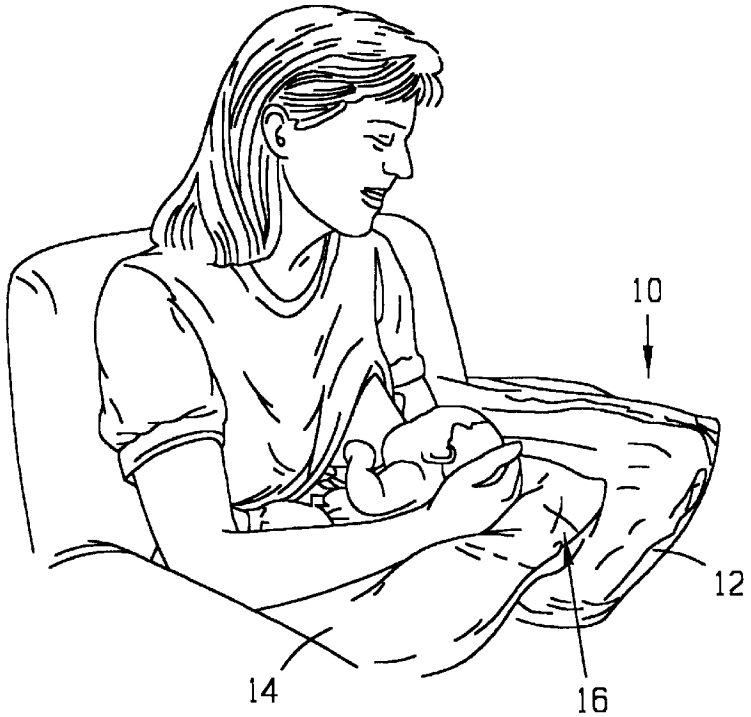
FIG. 2 is an illustration of the maternity support system in a beneficial position for feeding an infant in a "cross-cradle hold."
Figure 1:
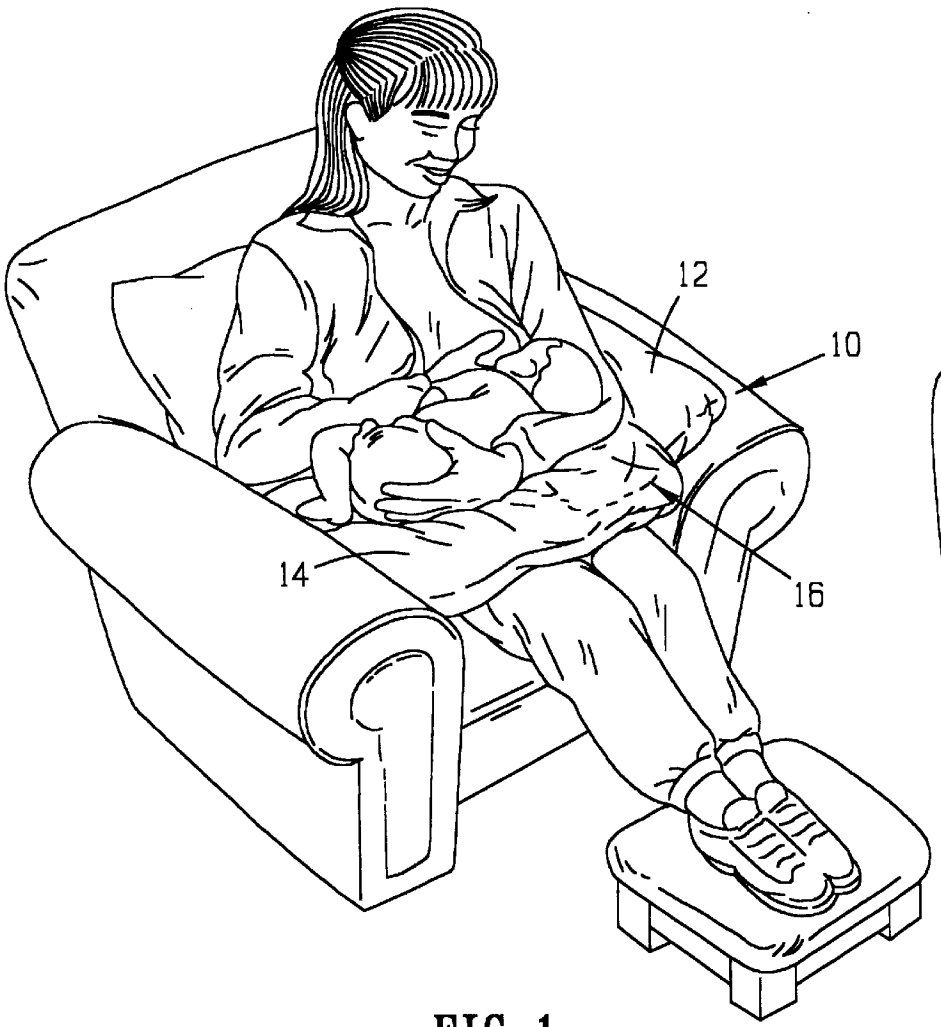
FIG. 1 is an illustration of the maternity support system in a beneficial position for feeding an infant in a "madonna" or "cradle hold."
Figure 4:
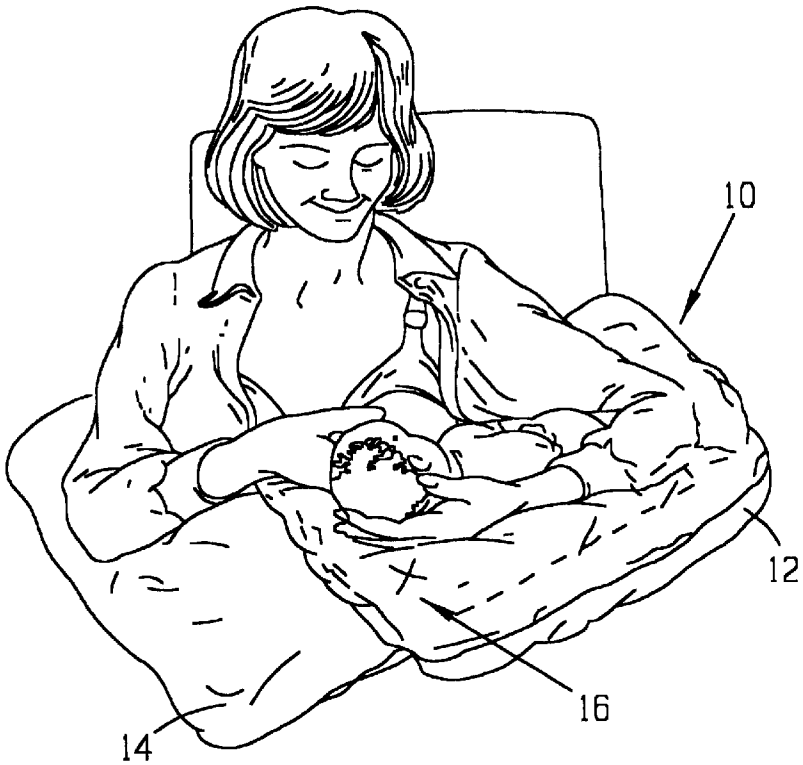
FIG. 4 is an illustration of the maternity support system in a beneficial second position for feeding an infant in a "football hold."
Figure 3:
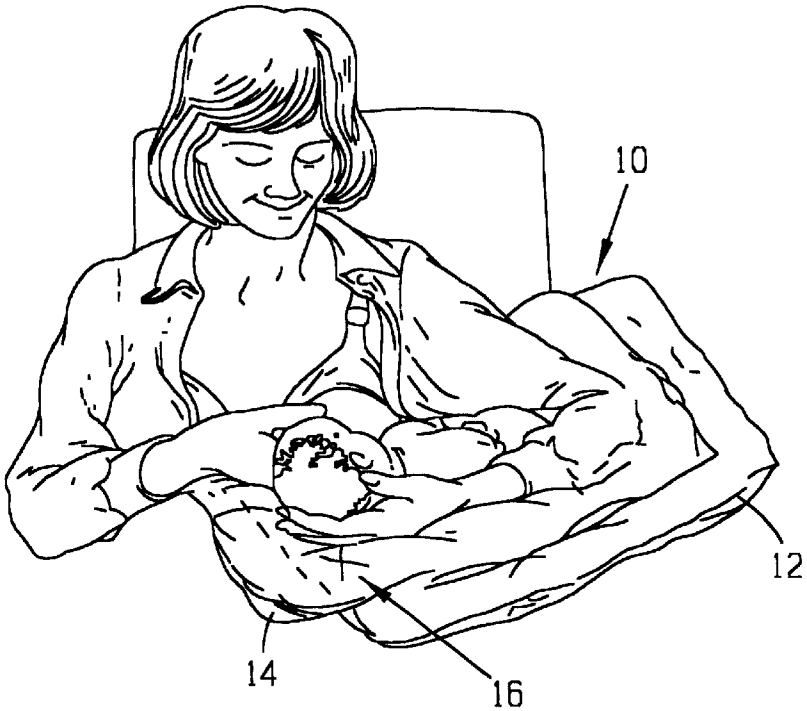
FIG. 3 is an illustration of the maternity support system in a beneficial first position for feeding an infant in a "football hold."
Figure 5:
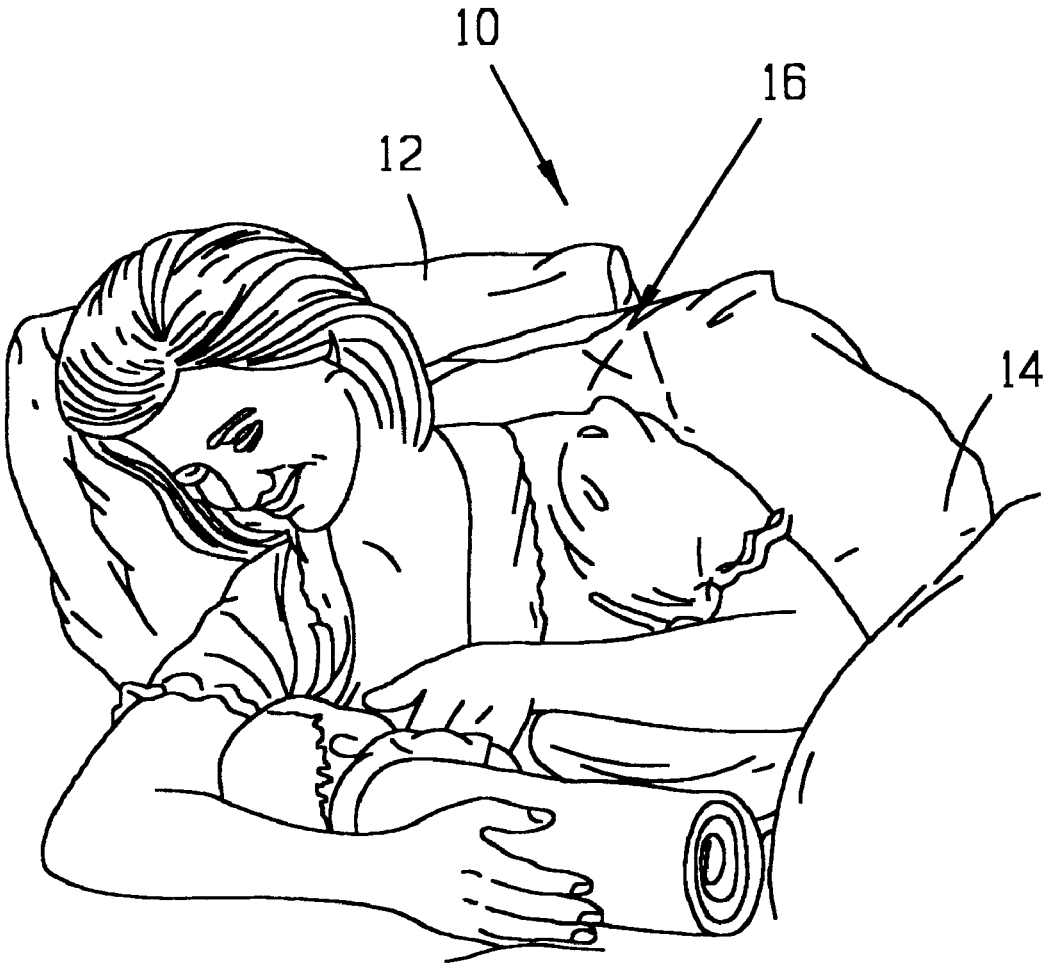
FIG. 5 is an illustration of the maternity support system in a beneficial position for supporting a mother who is lying down to feed an infant.

Firstly, pregnant women are advised to sleep on their side. In order to take weight off of the sacroiliac joint and to decrease back pain, it is desirable for them to sleep with one pillow between their knees an another pillow supporting the pregnant abdomen. Secondly, the length and repetition of holding the infant during feeding can cause considerable discomfort to the caregiver. FIGS. 1–5 illustrate four feeding positions in which mothers typically orient themselves during breastfeeding, and further illustrate the use of the maternity support system for each of these positions which is discussed in more detail below. The "Madonna" or "Cradle Hold" is illustrated in FIG. 1, the "Cross Cradle Hold" is illustrated in FIG. 2, the "Football Hold" is illustrated in FIGS. 3 and 4, and the a "Lying Down" position or "Side-lying Hold" is illustrated in FIG. 5.

Thirdly, proper positioning of an infant during feeding is important as it facilitates the infant's comfort, proper "latching-on" of the mouth to the breast during breastfeeding, and satisfactory nutrition. The desired infant position for breastfeeding is when one can draw an imaginary straight line from the infant's ear to the shoulder and to the hip. Additionally, the infant's knees and elbows should be bent so that the body is slightly flexed. It is believed that it is easier for the infant to suck and swallow when the infant's body is lined up in this configuration. Fourthly, as the infant grows in coordination and strength and learns to sit independently, it is desirable to place padding to provide some support for the infant in a sitting position and to protect the infant when he or she tips.

The maternity support system 10 generally comprises a first element 12 and a second element 14 connected to the first element 14. The first element 12 and the second element 14 are positioned and arranged with respect to each other for a maternity support use as described above. The elements may either be integrally formed as a unitary support article, or may be independent. Examples of a unitary support article are illustrated in FIGS. 28–33. FIGS. 28 and 30 illustrate how an "L" shaped unitary support article can be positioned around a caregiver. The "L" shape is desirable for the "Cradle Hold" of FIG. 1, the "Football Hold" of FIG. 4, and the "Lying Down Hold" of FIG. 5. FIG. 32 illustrate an inverted V-shaped unitary support article, which is desirable for the "Cross Cradle Hold" of FIG. 2. The unitary support article may be comprised of formed foam, for example, wherein each element forms an appendage or leg of the article. It is anticipated that other materials may be used to form the unitary support article.

In a preferred embodiment, the first and second elements 12 and 14 of the maternity support system are independent elements that are removably attached to each other using a connector 16. This enables the first 12 and second elements 14 to have an adjustable position with respect to each other, which allows the maternity support system 10 to be adjusted for a desired maternity support use. For example, the elements 12 and 14 may be adjusted from an "inverted V" shape to an "L" shape. Additionally, the elements 12 and 14 may be adjusted to fit about a caregiver or fit in a furniture piece. The connector 16 may comprise one or more types fasteners. As the caregiver already has her hands full with the infant, it is desirable that the fasteners be easy to use. Snaps 18, buttons, hook and eye fasteners, clasps, adhesive strips, and/or VELCRO hook and loop fasteners 20 may be used. FIGS. 25*a*, 26*a* and 27*a* illustrate snap connectors 18 that enable the elements 12 and 14 to stay in the desired shape for the desired maternity support.

Preferably, cooperating hook and loop fastener strips are attached to each element, whereby one element has a hook strip and the other element has a cooperating loop strip.

Figure 6:
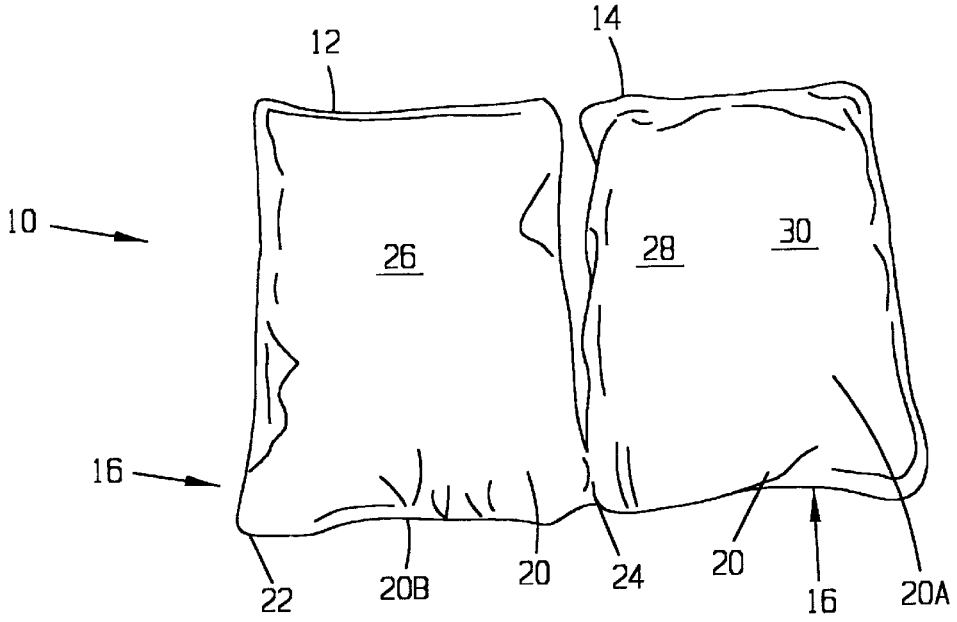
FIG. 6 is an illustration of the maternity support system that comprises a set of pillow shams for use with conventional bed pillows.
Figure 7:
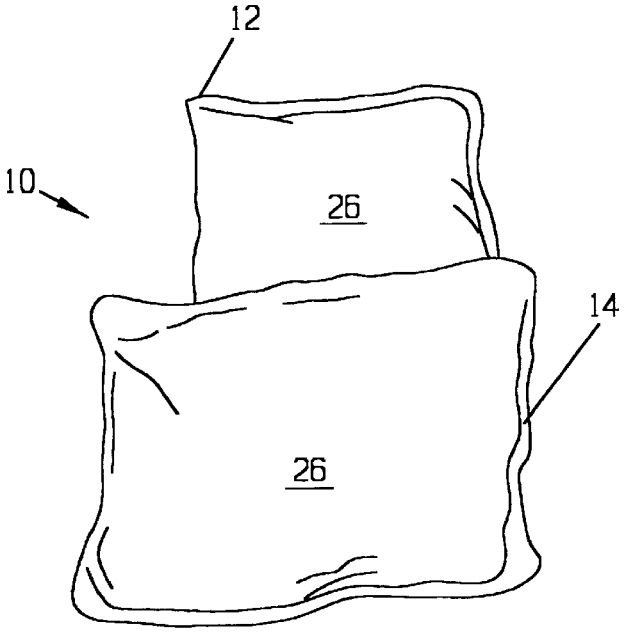
FIG. 7 is an illustration of the maternity support system of FIG. 6 arranged in a "L" configuration.

Referring to FIG. 6, an "L" shaped strip 20*a* may be attached to one element and a straight strip 20*b* may be attached to the other element. The L-shaped strip enables more cooperating surface area between the hook and loop strips for both an aligned position as illustrated in FIG. 3, or an orthogonal position as illustrated in FIG. 7. However, as illustrated by the alternative fastener placement examples in FIGS. 23*a* through 23*e* and the corresponding examples in FIGS. 24*a* through 24*e*, there are other functional ways of positioning and attaching the hook and loop fasteners to the elements. It is anticipated that, in lieu of the strips, combinations of other shapes including, inter alia, squares, circles, diamonds, triangles, and rectangles may be used for the VELCRO fastener design.

Both the first element 12 and second element 14 preferably comprise a flexible body 22 and 24 adapted for receiving a pad. The element is formed by placing a pad within the flexible body. Because of the desirability to use the caregiver's own personal conventional bed pillows for both economic and familiarity reasons, a pillow cover may be used as the flexible body. Pillow covers include pillow cases or slips which have an end opening through which a pillow is inserted, and also include pillow shams which have overlapping flaps on the back through which the pillow is inserted. Pillow shams are believed to retain the pillow in place better than pillow cases and are thus a preferred embodiment. Therefore, when pillows or other pads are combined with the pillow shams, the resultant elements are connected to one another, via their respective connectors, in a variety of orientations to form a maternity support system.

2. Maternity Support Set.

The maternity support set is a set of items that are used to form a maternity support system that is adapted for a maternity use, and generally comprises at least two flexible bodies 22 and 24 and at least one connector 16 adapted for removably attaching the flexible bodies together to form a maternity support system adapted for a maternity support use, as described above. Each flexible body is adapted for receiving a pad to form an element of the support system.

In the preferred embodiment, the flexible bodies are constructed of fabric such as cotton or a cotton blend and has a rectilinear, flat initial configuration. Each body has a first panel 26. Second 28 and third panels 30 are attached, preferably via conventional stitching, and preferably about the periphery or portions of the periphery of the respective panels, to the first panel and overlap to form an opening through which a pillow or other pad may be inserted, covered and retained within the body.

The flexible bodies 22 and 24 may be constructed in a variety of sizes and shapes using a variety of natural and/or synthetic materials. The material is preferably soft and flexible, to compliment the contained pillow or pad. The material may be fluid resistant or coated with a fluid resistant material. The flexible bodies may be disposable.

The connector 16 is preferably a flexible hook and loop type connector such as VELCRO fasteners 20. The connector is oriented in a predetermined configuration and at a predetermined region of the flexible body. The preferred configuration is that one cover have a strip disposed along one end of the cover and a second cover have an "L" shaped member centrally disposed with respect to the end of the panel with one arm parallel to the end and a second arm perpendicular to the end. A few of the many alternative configurations are shown in FIGS. 23*a*–24*e*. Alternative connectors may include buttons, snaps, clasps, hooks such as eye hooks, adhesive strips, or other connectors which preferably permit attachment and release, and preferably permit alteration of the orientation of the two covers and their respective support members.

The maternity support set may further include a bag 32 adapted for packaging, storing, and laundering the flexible bodies. The bag 32 includes a mesh bottom 34 and mesh sides 36 that define a soft-sided, cylindrically-shaped device with an opening. The bag includes a draw string 38 adapted for closing the opening. Each flexible body is preferably a pillow cover, such as a pillow sham, adapted for receiving a conventional bed pillow; and the connector is preferably VELCRO hook and loop fasteners sewn onto the pillow covers.

3. Pattern for Making a Pillow Cover Set.

The pattern for making a pillow cover set adapted for providing maternity support generally comprises at least one connection pattern piece 40 adapted for instructing a person to attach connectors to at least two pillow covers. The connection pattern piece(s) is preferably a hook and loop fastener pattern piece adapted for instructing the person to attach hook and loop fasteners to the pillow covers. The pattern may further comprise at least one pillow cover pattern piece 42 adapted for instructing the person to make the pillow covers. The pillow cover pattern piece(s) preferably is a pillow sham pattern piece adapted for instructing the person to make pillow shams.

The assembly of the first pillow sham and the second pillow sham is generally illustrated in FIGS. 21*a–c* and 22*a–c* respectively. FIGS. 9*a* through 11*b* show the fabric patterns or elements used in the manufacture of the first pillow sham, and FIGS. 12*a* through 20 show the elements for these assemblies.

The steps associated with FIG. 21*a* include: (1) pinning the edging assembly 44 onto the right side of the Pillow Back #1, matching the raw edges; (2) machine basting as close to the cord 46 as possible without sewing onto the cord 46; (3) clipping the edge and carefully pivoting the foot with a needle still in the fabric when sewing the edging to a comer; and (4) ripping open the stitching on the edging assembly 44, overlapping and restitching when the edging meets. The steps associated with FIG. 21*b* include: (1) placing Front A #1 30 (without VELCRO strips), wrong side up, onto Back #1 26; and (2) matching up the bottom tab and pinning onto Back #1 26 so that edging 44 is between the fabric. The steps associated with FIG. 21*c* include: (1) placing Front A #1 30, wrong side up, onto Back #1 26 and Front B #1 28 so that the right sides will be together; (2) matching up the tabs and pinning onto Back #1 26 so that the edging 44 is between the fabric; and (3) stitching ⅝" without stitching over the edging.

The steps associated with FIG. 22*a* include: (1) pinning the edging assembly 44 onto the right side of the Pillow Back #2 26, matching the raw edges; (2) machine basting as close to the cord 46 as possible without sewing onto the cord 46; (3) clipping the edge and carefully pivoting the foot with a needle still in the fabric when sewing the edging to a corner; and (4) ripping open the stitching on the edging assembly 44, overlapping and restitching when the edging meets. The steps associated with FIG. 22*b* include: (1) placing Front B #2 28 (with VELCRO strips), wrong side up, onto Back #2 26 so that right sides will be together; and (2) matching up the top tab and pinning onto Back #2 26 so that edging is between the fabric. The steps associated with FIG. 22*c* include: (1) placing Front A #2 30, wrong side up, onto Back #2 26 and Front B #2 28, (2) matching raw edges with the edging 44 between the material; and (3) stitching ⅝" without stitching over the edging.

4. Method of Making a Maternity Support System.

The method of making a maternity support system for use with at least two conventional bed pillows generally comprises the steps of selecting a set of at least two pillow covers and attaching a connective device to said at least two pillow covers. Each of the pillow covers is adapted for receiving a conventional bed pillow. Each pillow cover is removably attached to another pillow cover in the set. In a preferred embodiment the pillow covers are pillow shams, and the connective device is a VELCRO hook and loop fastener. The step of selecting a set of at least two pillow covers may further include the step of making the pillow covers, as described above, or it may include the steps of buying or otherwise obtaining the pillow covers. The method of making a maternity support system for use with at least two conventional bed pillows may further include the step of inserting a conventional bed pillow in each pillow cover.

5. Method of Providing Maternity Support to a Caregiver Feeding an Infant.

The method of providing maternity support to a caregiver feeding an infant generally comprises the step of orientating a predetermined shape of a first element and a second element in a maternity support system about a caregiver. An orientated predetermined shape provides maternity support for a desired feeding position. These feeding positions include a "Cradle Hold" position, a "Cross-Cradle Hold" position, a "Football Hold" position, and a "Lying Down" position. The method of providing maternity support to a caregiver feeding an infant may further comprise the steps of attaching the first element to the second element to form the predetermined shape, and forming the first and second elements by inserting a standard bed pillow into a first and second pillow cover.

Referring again to FIG. 1, the "Madonna" or "Cradle Hold" involves taking a sitting position and possibly raising the feet to take some pressure off of the back. The elements, i.e. pillows within the pillow shams in the preferred embodiment, have an "L"shape. One element lies straight across the lap and the other lies along the side. The elements overlap and are secured by attaching the VELCRO fasteners at the "X" position. Alternatively, rather than forming the "L" shape, the elements may overlap on top of each other in an aligned position.

Referring again to FIG. 2, the "Cross Cradle Hold" also involves taking a sitting position and possibly raising the feet. The elements may be positioned in the "L" shape as described above, or as illustrated, may be positioned in an "inverted V" shape. An element is placed on each side of the caregiver. The elements overlap in the center of the caregiver's lap, and are attached together using the VELCRO fasteners at the "X" position. In this position, the elements help to support both the infant and the caregiver's arms.

Referring again to FIGS. 3 and 4 the "Football Hold" also involves taking a sitting position and possibly raising the feet. The infant is positioned at the side of the caregiver. Two beneficial positions for the elements of the maternity support system include (1) overlapping the elements on top of each other in an aligned position along the side of the caregiver, and (2) forming an overlapping "inverted V" or "L" shape. In either of these positions, the elements are attached together using the VELCRO fasteners at the "X" position.

Referring again to FIG. 5, a "Sidelying Hold" involves lying down by a caregiver who is temporarily uncomfortable sitting up or who may want to rest while feeding. The elements are positioned in an "L" shape, with one element under the caregiver's head and the other along caregiver's back. Once again, the elements are attached together using the VELCRO fasteners at the "X" position.

The above examples of maternity support arrangements are directed toward a mother nursing an infant. It is within the purview of this invention that the support members may be oriented in a variety of other configurations to support an expectant mother's body during pregnancy, to support a caregiver feeding an infant, to support an infant during feeding and to support an infant learning to sit.

Although the above description and the illustrations show and generally describe the invention used in breastfeeding, it is within the purview of the invention that the support system is useable by a mother, father or other caregiver during bottle feeding or other feeding of an infant.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A maternity support set, comprising:

(a) a first flexible pillow sham adapted for receiving a pillow, said first pillow sham having at least one face with a peripheral edge, said first pillow sham having a first hook and loop fastener connector disposed along one peripheral end of said first pillow sham, said first connector having a straight strip configuration; and (b) a second flexible pillow sham adapted for receiving a pillow, said second pillow sham having at least one face with a peripheral edge, said second pillow sham having a second hook and loop fastener connector which hook and loop fastener is complementary and connectable to said hook and loop fastener of said first connector, said first and second connectors being adapted for removably attaching said pillow shams together to form, when enclosing respective pillows, a maternity support system adapted for supporting a caregiver and a feeding infant during feeding, said second fastener having an "L" shape in a substantially planar dimension and being centrally disposed with respect to one peripheral end of said second pillow sham, said second fastener having a first strip oriented parallel with respect to said peripheral end and a second strip extending from one end of said first strip, perpendicular to said first strip and away from said peripheral end, whereby said straight first connector and said L-shaped second connector permit removably attaching said pillow shams directly to each other in a relatively aligned first position and a relatively orthogonal second position the combination of first and second positions selected from the group of maternity support positions consisting of: a cradle hold, a cross cradle hold, a football hold, a lying down position and a sidelying hold.

2. The maternity support set of claim 1, further comprising a bag adapted for packaging, storing, and laundering said at least two flexible bodies.

3. The maternity support set of claim 2, wherein said bag includes a mesh bottom and mesh sides that define a soft-sided, cylindrically-shaped device with an opening, and further includes a draw string adapted for closing said opening.

* * * * *